US010094190B2

(12) United States Patent
Grattan et al.

(10) Patent No.: US 10,094,190 B2
(45) Date of Patent: Oct. 9, 2018

(54) DOWNHOLE SEVERING TOOLS EMPLOYING A TWO-STAGE ENERGIZING MATERIAL AND METHODS FOR USE THEREOF

(71) Applicant: Halliburton Energy Services, Inc., Houston, TX (US)

(72) Inventors: Antony F. Grattan, Mansfield, TX (US); Justine M. Davidson, Burleson, TX (US); Steve S. Lin, Mansfield, TX (US); Kevin O. Morton, Mansfield, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 47 days.

(21) Appl. No.: 15/121,233

(22) PCT Filed: Apr. 4, 2014

(86) PCT No.: PCT/US2014/032916
§ 371 (c)(1),
(2) Date: Aug. 24, 2016

(87) PCT Pub. No.: WO2015/152934
PCT Pub. Date: Oct. 8, 2015

(65) Prior Publication Data

US 2017/0016297 A1 Jan. 19, 2017

(51) Int. Cl.
*E21B 29/02* (2006.01)
*E21B 43/116* (2006.01)
(Continued)

(52) U.S. Cl.
CPC ..... *E21B 29/02* (2013.01); *C06B 33/08* (2013.01); *E21B 31/002* (2013.01); *E21B 43/116* (2013.01); *F42D 1/02* (2013.01)

(58) Field of Classification Search
CPC ..... E21B 29/02; E21B 43/116; E21B 31/002
See application file for complete search history.

(56) References Cited

U.S. PATENT DOCUMENTS 2,982,641 A 5/1961 Dawson et al.
4,290,486 A * 9/1981 Regalbuto ..... E21B 29/02 102/312

(Continued)

OTHER PUBLICATIONS

International Search Report and Written Opinion for PCT/US2014/032916 dated Dec. 24, 2014.

*Primary Examiner* — Cathleen R Hutchins
(74) *Attorney, Agent, or Firm* — McDermott Will & Emery LLP

(57) ABSTRACT

It is sometimes necessary to sever a downhole tubular structure in the course of conducting subterranean operations. Detonation of an explosive material may be used to sever a tubular structure in some instances. Downhole severing tools may comprise: a housing; a two-stage energizing material within the housing, the two-stage energizing material comprising a high explosive and a reactive energizing material; at least one initiator coupled to the two-stage energizing material at least at a first location; and a detonator coupled to the at least one initiator; wherein upon detonation of the two-stage energizing material, the high explosive undergoes a primary reaction that propagates a secondary reaction of the reactive energizing material.

31 Claims, 3 Drawing Sheets

(51) Int. Cl.

| | |
|---|---|
| ***F42D 1/02*** | (2006.01) |
| ***C06B 33/08*** | (2006.01) |
| ***E21B 31/00*** | (2006.01) |

(56) References Cited

U.S. PATENT DOCUMENTS

| | | | | |
|---|---|---|---|---|
| 5,117,911 | A | 6/1992 | Navarette et al. | |
| 5,129,322 | A | 7/1992 | Christopher et al. | |
| 7,104,326 | B2 | 9/2006 | Grattan et al. | |
| 7,393,423 | B2 | 7/2008 | Liu | |
| 8,168,016 | B1 | 5/2012 | Nicolich et al. | |
| 8,302,534 | B2 | 11/2012 | Yang et al. | |
| 2003/0047312 | A1 | 3/2003 | Bell | |
| 2005/0126783 | A1 | 6/2005 | Grattan et al. | |
| 2005/0268776 | A1 | 12/2005 | Bell | |
| 2008/0034951 | A1* | 2/2008 | Evans | E21B 43/117 89/1.15 |
| 2010/0096136 | A1* | 4/2010 | Bourne | F42B 1/032 166/299 |
| 2011/0283872 | A1 | 11/2011 | Brooks | |
| 2012/0067578 | A1 | 3/2012 | Wood et al. | |

* cited by examiner

DOWNHOLE SEVERING TOOLS EMPLOYING A TWO-STAGE ENERGIZING MATERIAL AND METHODS FOR USE THEREOF

BACKGROUND

The present disclosure generally relates to severing tubular structures in a downhole environment, and, more specifically, to tools and methods employing an explosive material for severing downhole tubular structures.

Modern wellbores can extend thousands of feet below the earth's surface and be several miles in overall length, particularly if the wellbore is deviated with one or more substantially non-vertical sections. In most instances, one or more tubular structures are present within a wellbore at various points during its lifecycle. Illustrative tubular structures that commonly may be present within a wellbore include, for example, casing, drill pipe, drill collars, production tubing, coiled tubing, and the like. Such tubular structures often may be used in conjunction with introducing a fluid to a particular location of a subterranean formation or with producing a fluid from a subterranean formation. Tubular structures may also provide other downhole functions.

Under ordinary operational circumstances, most tubular structures extend from the earth's surface to a location along the length of the wellbore in order to allow a well operator to manage ongoing operations therein. In some instances, various events in a wellbore can necessitate severing a tubular structure within the wellbore at a location below the earth's surface. The terms "sever" and "cut" and grammatical equivalents thereof will be used interchangeably with one another herein. The most common operational circumstance necessitating severing of a downhole tubular structure is a condition known as stuck pipe. As used herein, the term "stuck pipe" refers to a state in which a downhole tubular structure cannot be rotated, moved along the length of the wellbore, or any combination thereof. A number of events within the wellbore can lead to an occurrence of stuck pipe including, for example, collapse of a section of the wellbore wall, accidental contact of the tubular structure with an uncased section of the wellbore wall, and the like. Most significantly, stuck pipe can prevent a tubular structure from fully extending all the way from the earth's surface to an intended location within the wellbore.

One way in which rapid severing of a tubular structure may take place is through detonation of an explosive material. In performing explosive severing of a stuck pipe, the position and depth of the tubular structure in the wellbore, among other factors, can first be determined (e.g. using a wireline tool), and then a tool containing an explosive material can be lowered through the tubular structure to the measured location or above. The explosive material is then detonated to result in severance of the tubular structure. The physical size of the explosive material in the tool may be dictated by the inner diameter of the tubular structure, as well as by the volume of the tool itself. The explosive can be configured to provide brute force severing or designed cutting of the tubular structure.

Although explosive severance of a tubular structure can often be successfully accomplished, it may sometimes be the case that an explosive material having a great enough explosive yield to result in severing cannot be effectively lowered though a particular tubular structure. That is, the diameter and internal volume of a severing tool may not allow a sufficient amount of explosive material to be positioned in a tubular structure to affect its severance, for example due to downhole hydrostatic pressure and the wall thickness of the tubular structure. In this instance, there are presently few options available for a well operator to increase explosive yield.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
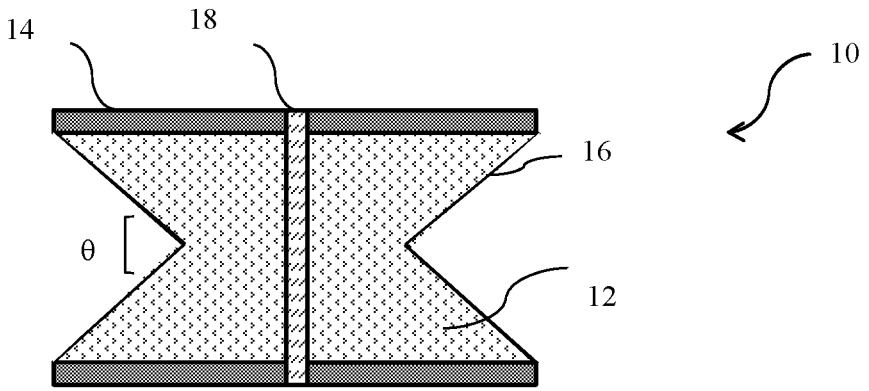
FIG. 1 is a diagram showing an illustrative schematic of a conical shaped charge containing a two-stage energizing material in accordance with aspects of the present disclosure.

The present disclosure generally relates to severing tubular structures in a downhole environment, and, more specifically, to tools and methods employing an explosive material for severing downhole tubular structures.

One or more illustrative embodiments incorporating the features of the present disclosure are presented herein. Not all features of a physical implementation are described or shown in this application for the sake of clarity. It is to be understood that in the development of a physical embodiment incorporating the features of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for one of ordinary skill in the art and having benefit of this disclosure.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

While tools and methods are described herein in terms of "comprising" various components or steps, the tools and methods can also "consist essentially of" or "consist of" the various components and steps.

As indicated above, explosive severing operations in a downhole environment may be limited in terms of explosive yield. The embodiments of the present disclosure utilize enhanced explosive compositions in conducting downhole severing operations that may result in increased operational reliability, among other advantages. More particularly, the downhole severing techniques and tools described herein utilize a two-stage energizing material comprising a high explosive and a reactive energizing material. As used herein, the term "high explosive" refers to a substance that undergoes a very rapid decomposition transition, from burning to detonation, over the course of milliseconds thereby producing a large amount of heat and/or shock. In many instances, a high explosive produces a gas upon detonation. Upon detonation of the two-stage energizing material in the present embodiments, the high explosive undergoes a primary reaction that subsequently propagates a secondary reaction of the reactive energizing material to produce an enhanced explosive event with a higher energetic yield than is attainable using a high explosive alone. Further disclosure regarding two-stage energizing materials and their components is provided below.

Advantageously, the two-stage energizing materials described herein can be configured as substantially a drop-in replacement for conventional high explosive materials utilized in existing downhole severing tools. Thus, the two-stage energizing materials may permit increased energetic yields to be realized during an explosive event without resorting to custom tool manufacturing, and while maintaining the same tool footprint. Alternately, the two-stage energizing materials can allow for the fabrication or use of tools having a smaller footprint than existing tools, while maintaining a similar energetic yield, thereby permitting severing operations to take place in more confined tubular structures.

In addition to the foregoing, the two-stage energizing materials described herein may be utilized in various configurations for severing different types of tubular structures, each in a variety of ways. Exemplary explosive severing techniques for particular downhole tubular structures are described immediately hereinafter.

For severing thinner tubular structures (e.g., production tubing), a clean, "finesse" cut of the tubular structure may be desirable. In such instances, a jet cut resulting from detonation of a shaped charge may be desirable. As used herein, the term "shaped charge" refers to an explosive structure that is configured to preferentially focus the force of its detonation in a specific direction. Further disclosure regarding shaped charges follows below. As used herein, the term "jet cut" and variants thereof refer to a cut obtained from a high velocity stream (i.e., a "jet") of a substance ejected from a shaped charge upon its detonation. Interaction of the jet with a tubular structure may result in severance of the tubular structure. Accordingly, in some embodiments, shaped charges comprising a two-stage energizing material are described herein. In other embodiments, a two-stage energizing material may be used in combination with a shaped charge comprising a standard high explosive. That is, in some embodiments, a two-stage energizing material may be used in conjunction with a shaped charge comprising a conventional high explosive in order to supplement the shaped charge's jet cutting effects. Further disclosure of how two-stage energizing materials may be used within or in combination with a shaped charge follows hereinbelow.

When severing very thick walled tubular structures, such as a drill collar, a higher explosive force may be needed than when severing thinner walled tubular structures, such as production tubing. When severing thicker walled tubular structures, a brute force explosion to sever the tubular structure by any means possible may be acceptable as an operation of last resort. Of course, thinner walled tubular structures may be severed in a like manner, if desired. In brute force severing operations, severing may take place due to an outward pressure wave produced by the detonation event, rather than through a jet cutting effect, thereby bursting the tubular structure open with an irregular cutting edge. In some embodiments, an explosive charge may be configured in a columnar or like elongate form and detonated from opposing ends of the columnar form, such that shockwaves propagate from each end toward the center of the columnar form and additively combine there to produce an outward pressure wave. The additive combination of the opposing shockwaves effectively increases the explosive yield without increasing the amount of explosive material in the severing tool. A shaped charge located at the shockwave collision point may optionally be used to further enhance the severing effect. For example, detonation of the shaped charge may at least partially cut the tubular structure prior to or concurrently with the arrival of the opposing shockwaves.

A number of compositions comprising a two-stage energizing material may be suitable for use in the embodiments disclosed herein and are described in further detail below. In general, the two-stage energizing materials may produce an explosive event that is longer in duration and increased in energetic yield compared to that attainable with a single high explosive or a mixture of high explosives acting independently of one another. Particularly desirable two-stage energizing materials may include those comprising a thermobaric material as the reactive energizing material. As used herein, the term "thermobaric material" refers to a substance that undergoes a reaction with a detonation product of a high explosive and/or with a component of the surrounding environment following an initial explosive event to produce a long duration, high temperature secondary reaction, often accompanied by the generation of a sustained shockwave. Detonation products of the primary reaction that may be reacted include, for example, water, carbon dioxide, carbon monoxide, oxygen and nitrogen. These components may also be present as part of the immediate environment surrounding the reactive energizing material. The secondary reaction may also be enhanced with an oxidizer or like material in the two-stage energizing material if the surrounding environment is deficient in a needed component, or if a needed component becomes depleted during the initial explosive event.

In various embodiments, the thermobaric material may comprise a metal. Illustrative metals that may comprise a thermobaric material include metals such as, for example, aluminum, titanium, zirconium, barium potassium, cesium, sodium, magnesium, and any combination thereof. Nonmetallic substances that may comprise a thermobaric material in a two-stage energizing material include, for example, boron, silicon, and carbon. Hydrocarbons may also comprise a thermobaric material in some embodiments. Tailoring of the energetic yield produced from the secondary reaction of a thermobaric material may take place by combining varying quantities of the above substances with one another. In this regard, any combination of one or more metallic and/or one or more non-metallic thermobaric materials may be used in the embodiments described herein.

The high explosive used in the two-stage energizing materials described herein is not believed to be particularly limited. In general, any standard high explosive or combination thereof may be detonated to produce the primary reaction of the two-stage energizing material. Illustrative high explosives that may be used to produce the primary reaction in the embodiments described herein include, for example, TNT (2,4,6-trinitrotoluene), RDX (cyclotrimethylenetrinitramine), HMX (octahydro-1,3,5,7-tetranitro-1,3,5,7-tetrazocine), HNS (hexanitrostilbene), CL-20 (2,4,6,8,10,12-hexanitro-2,4,6,8,10,12-hexaazaisowurtzitane), PETN (pentaerythritol tetranitrate), TATB (2,4,6-triamino-1,3,5-trinitrobenzene), PYX (2,6-bis(picrylamino)-3,5-dinitropyridine), BRX (1,3,5-trinitro-2,4,6-tripicrylbenzene) and the like. In various embodiments, the high explosive may be paired with a binder component, such as a plasticizer, so that it can be pressed into a suitable form, such as in a shaped charge or a reactive disk. As used herein, the term "reactive disk" refers to a three-dimensional structure that is stackable, without reference to the thickness or shape thereof. Reactive disks may be used synonymously herein with the term "reactive pellets."

When using a two-stage energizing material, the high explosive and the reactive energizing material (e.g. a thermobaric material) may be intimately mixed in the two-stage energizing material, or they may be separated from one another. For example, a two-stage energizing material may be created by forming reactive disks from a high explosive and reactive disks from a reactive energizing material, and then stacking the two types of reactive disks upon one another in any combination. Likewise, in alternative embodiments, a high explosive and a reactive energizing material may be present in the same monolithic structure (e.g., a reactive disk), but separated from one another, by including an inert material between the high explosive and the reactive energizing material.

It is believed that employing a two-stage energizing material that produces a primary reaction and a propagated secondary reaction may provide a number of advantages in the embodiments described herein. The primary reaction may produce a sharp pressure increase during an initial explosive event that serves to disperse a "cloud" of the reactive energizing material, while also supplying energy thereto. The energy supplied to the reactive energizing material can be sufficient to overcome the activation barrier for its reaction with the detonation products of the high explosive and/or a component of the surrounding environment. Although the peak pressure may be lower when a two-stage energizing material is utilized compared to that obtained with a high explosive alone, the sustained secondary reaction and accompanying shockwave may produce an enhanced explosive event relative to that attainable with only a high explosive.

As an example of the enhancement of an explosive event that may be realized when using a two-stage energizing material, the thermobaric reaction of aluminum particles will be described in greater detail. A two-stage energizing material comprising a high explosive and metallic aluminum can be formulated, and the high explosive can then be detonated through known techniques. Upon detonation, the high explosive undergoes a primary reaction that can disperse the metallic aluminum and elevate the temperature of the aluminum above its melting point of 660° C. The heat of detonation for most high explosives is in the range of approximately 4-6 kJ/gram, thereby supplying ample energy for melting a significantly larger quantity of metallic aluminum, whose heat of fusion is much lower and approximately 0.4 kJ/gram. The dispersed, molten aluminum then is sufficiently energetic to undergo a reaction with the detonation products of the primary reaction and/or components of the surrounding environment, such as oxygen, water, carbon monoxide, and carbon dioxide. The ongoing secondary reaction can produce a sustained shockwave or pressure impulse that is longer in duration and more energetic than that attainable with a conventional high explosive alone. That is, the initially lower energy output of the two-stage energizing material can be more than compensated for by the sustained energy release of the secondary reaction. The sustained shockwave or pressure impulse produced by the secondary reaction may be desirable for severing a variety of tubular structures.

Various ratios of the high explosive to the reactive energizing material are contemplated by the embodiments of the present disclosure. In some embodiments, the two-stage energizing material may comprise about 50% to about 95% by weight of the high explosive and about 5% to about 50% by weight of the reactive energizing material. In more particular embodiments, the two-stage energizing material may comprise about 5% to about 10% by weight of the reactive energizing material, or about 10% to about 15% by weight of the reactive energizing material, or about 15% to about 20% by weight of the reactive energizing material, or about 20% to about 25% by weight of the reactive energizing material, or about 25% to about 30% of the reactive energizing material, or about 30% to about 35% of the reactive energizing material, or about 35% to about 40% of the reactive energizing material, or about 40% to about 45% of the reactive energizing material, or about 45% to about 50% of the reactive energizing material. Choice of the amount of the reactive energizing material can be made to produce a desired energetic yield and duration of the secondary reaction.

In addition to an oxidizer, referenced above, the two-stage energizing material may comprise various additives that potentially enhance the explosive effect. Suitable additives may include, for example, a metal, a metal salt, a chloride salt, a fluoride salt, an acetate salt, a sulfate salt, a diazonium salt, a bromate salt, a chlorate salt, a chlorite salt, a perchlorate salt, a nitrate salt, a propellant, an oxidizer, or any combination thereof.

Suitable metals or metal salts may include reactive metals such as, for example, cesium, sodium, magnesium, aluminum, titanium, zirconium, barium, potassium, and the like. Noble metals such as, for example, platinum, palladium, gold, silver, or lead may be used in some embodiments. Suitable salts may include salt forms such as, for example, chloride salts, bromide salts, fluoride salts, acetate salts, sulfate salts, and the like.

Energetic salts such as, for example, diazonium salts, bromate salts, chlorate salts, chlorite salts, perchlorate salts, and nitrate salts may be used in the two-stage energizing materials in some embodiments. Suitable perchlorate salts may include, for example, sodium perchlorate, potassium perchlorate, or ammonium perchlorate. A suitable salt form may be chosen to adjust the amount of energy produced during the explosive event.

Suitable propellants that may be used in the two-stage energizing materials include, for example, gasoline, fuel oil, diesel, ethanol, methanol, kerosene, black powder, nitrocellulose, ammonium nitrate, ammonium perchlorate, and the like.

Suitable oxidizers that may be used in the two-stage energizing materials include, for example, hydrogen peroxide, nitric acid, ammonium nitramide, and the like.

The various additives above may play a single role in the two-stage energizing materials, or they may play two or more roles. For example, ammonium perchlorate may serve both as a propellant and as an oxidizer in the two-stage energizing materials.

In various embodiments, the two-stage energizing materials described herein may comprise at least some particulates that are about 1 micron or less in size. That is, in some embodiments, the two-stage energizing materials may comprise nanoparticles. In more particular embodiments, the two-stage energizing material may comprise particulates that are between about 100 nm and about 500 nm in size, or between about 100 nm and about 200 nm in size. Without being bound by any theory or mechanism, it is believed that the high surface area of nanoparticles, particularly metal nanoparticles, can result in an increase in the energetic yield and a more complete energy release. Various techniques for synthesizing metal nanoparticles and other types of nanoparticles will be familiar to one having ordinary skill in the art. Micron-scale particles may also provide similar advantages in terms of their high surface area.

The embodiments of the present disclosure will now be described in greater detail with reference to the drawings, which depict various downhole severing tools containing a two-stage energizing material in accordance with various aspects of the present disclosure.

In some embodiments, shaped charges comprising a two-stage energizing material are described herein. In various embodiments of the present disclosure, shaped charges may comprise a cylindrical shaped charge, although shaped charges of other geometric forms such as, for example, linear shaped charges and curvilinear shaped charges may be formed in a like manner. In more particular embodiments, a cylindrical shaped charge may comprise a conical shaped charge, whose design and function are described hereinafter. In general, the shaped charges described herein have a concave region on their exterior. The exterior of the concave region is defined by a thin liner, behind which is housed an explosive material.

FIG. 1 is a diagram showing an illustrative schematic of a conical shaped charge containing a two-stage energizing material in accordance with aspects of the present disclosure. As depicted in FIG. 1, shaped charge 10 contains two-stage energizing material 12 within retainer 14 and held behind liner 16. Liner 16 defines a concave region having apex angle θ, which may range from about 30 degrees to about 120 degrees, and more typically from about 45 degrees to about 90 degrees. Two-stage energizing material 12 may comprise any of the two-stage energizing materials described herein, which may be compacted and shaped to a desired density behind liner 16. In various embodiments, retainer 14 may comprise a metal or a ceramic, and liner 16 may comprise a metal. Shaped charge 10 further contains initiator 18 (also referred to as an initiator component or a booster) passing longitudinally therethrough. In some embodiments, initiator 18 may comprise a detonating cord, such as an aluminum detonating cord, for example. Upon detonation of two-stage energizing material 12, liner 16 may collapse upon itself, thereby resulting in a jet of particles being directionally ejected from the explosive event. Use of shaped charges containing a two-stage energizing material may provide particular advantages in severing a tubular structure in certain instances that are discussed hereinafter.

Conventional conical shaped charges may be similar to the conical shaped charge of FIG. 1, which contains a two-stage energizing material. Namely, conventional conical shaped charges may contain a standard high explosive in place of two-stage energizing material 12. Use of a conventional shaped charge in combination with a two-stage energizing material separate from the shaped charge may also provide particular advantages in severing a tubular structure in certain instances that are described hereinafter. Again, it is to be recognized that reference herein to a shaped charge may refer to any suitable shaped charge configuration, not just the exemplary conical shaped charge configuration depicted in FIG. 1.

As described above, in some embodiments, a two-stage energizing material may be used in conjunction with achieving a precision cut of a tubular structure. A shaped charge may be employed in such embodiments, and the shaped charge may comprise a two-stage energizing material or a standard high explosive in various embodiments, depending on the particular requirements of the tubular structure being cut. In some embodiments, a "non-directional" two-stage energizing material may be used in conjunction with either type of shaped charge. Downhole severing tools exemplifying these various embodiments are described in greater detail hereinafter.

In some embodiments, downhole severing tools described herein may comprise a housing; a two-stage energizing material within the housing, the two-stage energizing material comprising a high explosive and a reactive energizing material; at least one initiator coupled to the two-stage energizing material at least at a first location; and a detonator coupled to the at least one initiator; wherein upon detonation of the two-stage energizing material, the high explosive undergoes a primary reaction that propagates a secondary reaction of the reactive energizing material.

In some embodiments, the downhole severing tool may comprise a shaped charge containing a two-stage energizing material as its only explosive charge. That is, in some embodiments, the downhole severing tool may comprise a two-stage energizing material configured as a shaped charge. The shaped charge may have a concave region on its exterior, where the exterior of the concave region is defined by a liner, behind which is housed the two-stage energizing material. A shaped charge of this type is exemplified by that shown in FIG. 1.

Figure 2:
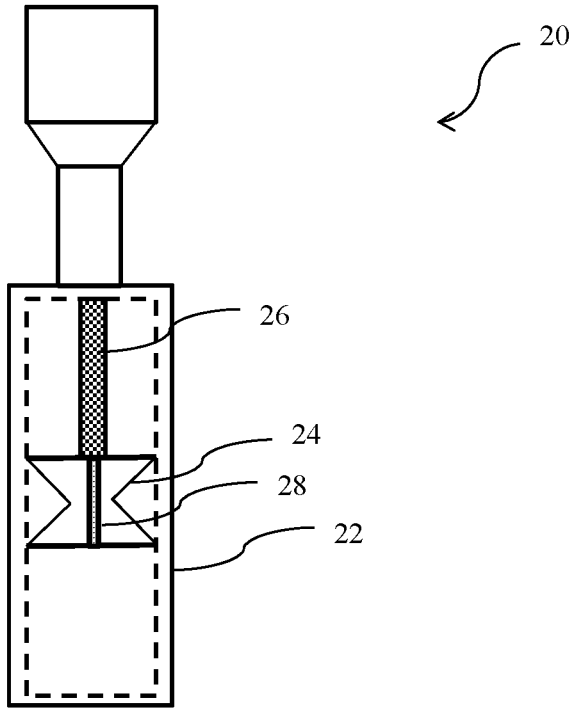
FIG. 2 is a diagram showing a cut-away schematic of an illustrative downhole severing tool comprising a shaped charge containing a two-stage energizing material in accordance with aspects of the present disclosure.

FIG. 2 is a diagram showing a cut-away schematic of an illustrative downhole severing tool comprising a shaped charge containing a two-stage energizing material in accordance with aspects of the present disclosure. As depicted in FIG. 2, tool 20 contains shaped charge 24 within housing 22. Shaped charge 24 is coupled to detonator assembly 26, which is directly or indirectly connected to upper portions of tool 20 extending to the earth's surface. As depicted in FIG. 2, initiator 28 extends longitudinally through shaped charge 24.

In some embodiments, a two-stage energizing material may be stacked above and below a shaped charge in the housing of the downhole severing tool. In some embodiments, the shaped charge may comprise a two-stage energizing material, similar to that described above. In other embodiments, the shaped charge may comprise a standard high explosive material alone. In more particular embodiments, the two-stage energizing material may be configured as a reactive disk or reactive pellets, where one or more reactive disks are stacked above and below a shaped charge in the housing.

Figure 3:
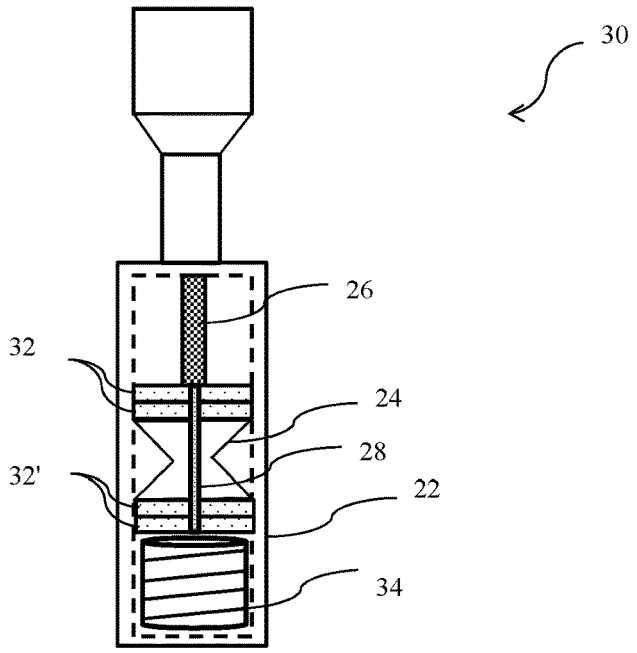
FIG. 3 is a diagram showing a cut-away schematic of an illustrative downhole severing tool comprising a shaped charge and a two-stage energizing material stacked above and below the shaped charge in accordance with aspects of the present disclosure.

FIG. 3 is a diagram showing a cut-away schematic of an illustrative downhole severing tool comprising a shaped charge and a two-stage energizing material stacked above and below the shaped charge in accordance with aspects of the present disclosure. As the configuration of FIG. 3 is similar to that depicted in FIG. 2, like reference characters will be used to describe elements having similar configurations and functions therein. Referring to FIG. 3, tool 30 contains shaped charge 24 within housing 22. Tool 30 also contains reactive disks 32 and 32' disposed above and below shaped charge 24, respectively. Although FIG. 3 has depicted two reactive disks 32 and 32' within tool 30 (4 disks total), it is to be recognized that any number may be present within the available loading space of the tool and to achieve a desired energetic yield. Stacking of reactive disks 32 and 32' and shaped charge 24 on one another may be performed by loading these components onto a central load rod and then lowering the load rod into housing 22. Any means to support reactive disks 32' may be employed in tool 30, such as spring 34 depicted in FIG. 3. Alternately, reactive disks 32' may rest on the bottom surface of tool 30.

In some embodiments of the configuration depicted in FIG. 3, a two-stage energizing material may be present in shaped charge 24 in addition to that present in reactive disks 32 and 32'. Use of a two-stage energizing material in both locations may provide particular advantages such as, for example, increased pressure impulse duration.

In other embodiments of the configuration depicted in FIG. 3, a standard high explosive material may be present in shaped charge 24 and the two-stage energizing material may be present only in reactive disks 32 and 32'. Use of a shaped charge containing a standard high explosive in combination with a two-stage energizing material above and below the shaped charge may provide particular advantages such as, for example, a higher pressure impulse behind a particle jet produced by shaped charge 24.

In the configuration depicted in FIG. 3, reactive disks 32 can be detonated in sequence before shaped charge 24 and reactive disks 32'. That is, the explosive materials can be detonated from the top down or bottom up via initiation at a single location. Alternately, shaped charge 24 can be detonated first, followed by reactive disks 32 and 32' thereafter, thereby providing a pressure impulse after the jet cutting action. In some embodiments, the tool may be configured with shaped charge 24 on top of or below reactive disks 32. That is, in such embodiments, reactive disks 32' may be omitted. Omission of reactive disks 32' may be particularly desirable if shaped charge 24 is being detonated first.

The previously described embodiments of a downhole severing tool may be utilized to make a precision cut through a wellbore tubular structure through a jet cutting action. Downhole severing tools configured to provide more aggressive cutting action may be desirable in certain situations, particularly for severing thick walled tubular structures such as, but not limited to, a drill collar. Such downhole severing tools may make use of colliding shockwaves generated from opposing ends of a columnar explosive charge in order to promote brute force severing of the tubular structure by bursting it open with an outward pressure wave at the colliding shockwaves' point of intersection. As used herein, the term "columnar" refers to any elongate structure without reference to shape of the structure along its longitudinal axis. That is, any elongate cylindrical or prismatic structure may comprise a columnar explosive charge in the embodiments described herein. Use of a two-stage energizing material to provide the colliding shockwaves is believed to provide advantages in severing a tubular structure due to the sustained secondary reaction. Various embodiments of downhole severing tools configured in such a manner are described hereinafter.

In some embodiments of the downhole severing tools, the two-stage energizing material may be configured in a columnar form within the housing, and first and second initiators may be coupled to the two-stage energizing material at opposing ends of the columnar form. In such embodiments, the opposing ends of the columnar form may be configured to detonate in sequence with one another. In sequence detonation can be performed such that shockwaves generated from opposing ends of the columnar form collide at a desired location within the columnar form to provide an outward pressure wave at that location, thereby effectively enhancing the energetic yield. As used herein, the term "in sequence" refers to the precision timing of two explosive events. In some embodiments, an in sequence detonation may comprise a substantially simultaneous detonation of the two-stage energizing material at the opposing ends of the columnar form. In other embodiments of an in sequence detonation, one of the ends of the columnar form may be detonated with a desired delay after detonation of the other end, so as to promote collision of the shockwaves generated from each end at a desired location of the columnar form. For example, if a two-stage energizing material in columnar form is not symmetrical along its longitudinal axis, a time-delayed detonation sequence may be used to promote collision of the shockwaves in the center of the columnar form or in another location by accounting for the shockwave travel time from each end of the columnar form.

Figure 4:
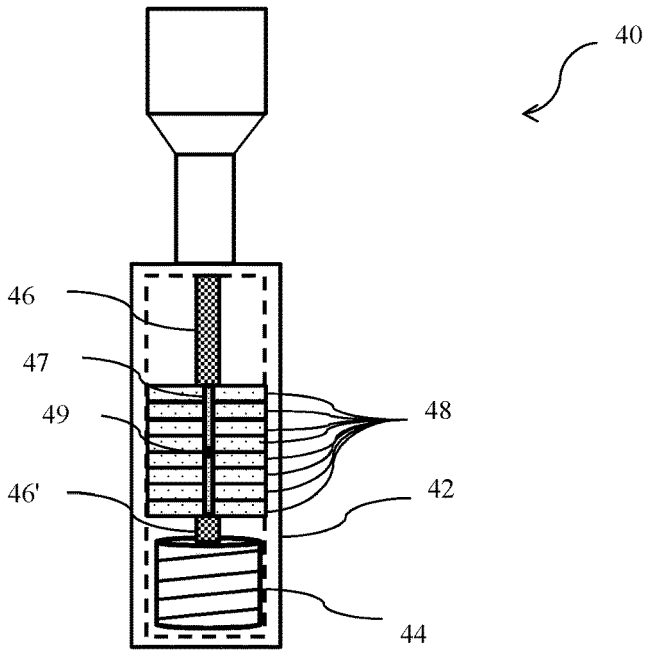
FIG. 4 is a diagram showing a cut-away schematic of an illustrative downhole severing tool containing a two-stage energizing material in columnar form that is configured to detonate from opposing ends of the columnar form in accordance with aspects of the present disclosure.

FIG. 4 is a diagram showing a cut-away schematic of an illustrative downhole severing tool containing a two-stage energizing material in columnar form that is configured to detonate from opposing ends of the columnar form in accordance with aspects of the present disclosure. The columnar form may be monolithic in some embodiments, or it may comprise a plurality of stacked reactive disks in other embodiments. In the interest of simplicity and for purposes of describing subsequent embodiments, a stacked reactive disk configuration is depicted in FIG. 4. It is to be recognized, however, that alternative configurations of the columnar form comprising the two-stage energizing material may be implemented in a similar manner. Loading and arming downhole severing tools comprising a two-stage energizing material in columnar form may take place similarly to that provided in the description above.

Referring to FIG. 4, tool 40 comprises a plurality of stacked reactive disks 48 within housing 42. Initiator 47, which may comprise an initiating assembly, extends through stacked reactive disks 48 to contact the opposing ends of the columnar form defined thereby. Suitable initiating assemblies may include an electrical wire with detonators at each end, or a mild detonating fuse with boosters at each end, which is initiated by a single detonator. At opposing ends of the columnar form are detonator assemblies or boosters 46 and 46'. Detonator assemblies or boosters 46 and 46' are configured to detonate the opposing ends of the columnar form in sequence with one another, as described in further detail above, to produce colliding shockwaves within the columnar form. A single detonator assembly may be wired to detonate the opposing ends of the columnar form in sequence with one another, rather than having the depicted separate detonator assemblies 46 and 46'. Supporting structure 44 may resemble and function similarly to spring 34 depicted in FIG. 3 and described above.

Optionally, the columnar form defined by reactive disks 48 may be detonated from a third location in addition to the opposing ends. In some embodiments, the columnar form may also be detonated at location 49 within the columnar form. Detonation at location 49 may be sequenced to coincide with the arrival of the shockwaves from the opposing ends of the columnar form, although it may also occur at other times.

Figure 5:
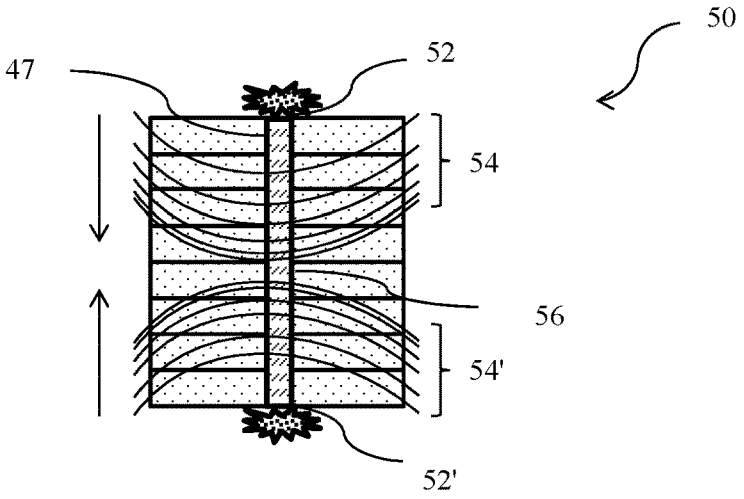
FIG. 5 is a diagram showing a schematic illustrating the collision of opposing shockwaves generated upon detonation of the columnar form of FIG. 4 in accordance with aspects of the present disclosure.

FIG. 5 is a diagram showing a schematic illustrating the collision of opposing shockwaves generated upon detonation of the columnar form of FIG. 4 in accordance with aspects of the present disclosure. As shown in FIG. 5, detonation of columnar form 50 proceeds from initiation points 52 and 52', located at opposing ends of columnar form 50, thereby generating shockwaves 54 and 54' that progress toward location 56 at a point between the opposing ends of columnar form 50. In some embodiments, location 56 may be substantially at the center of columnar form 50. Upon the additive combination of shockwaves 54 and 54' at location 56, an outward pressure wave is produced (not depicted) that has an enhanced magnitude and severing capability relative to the initial shockwaves 54 and 54' alone.

Figure 6:
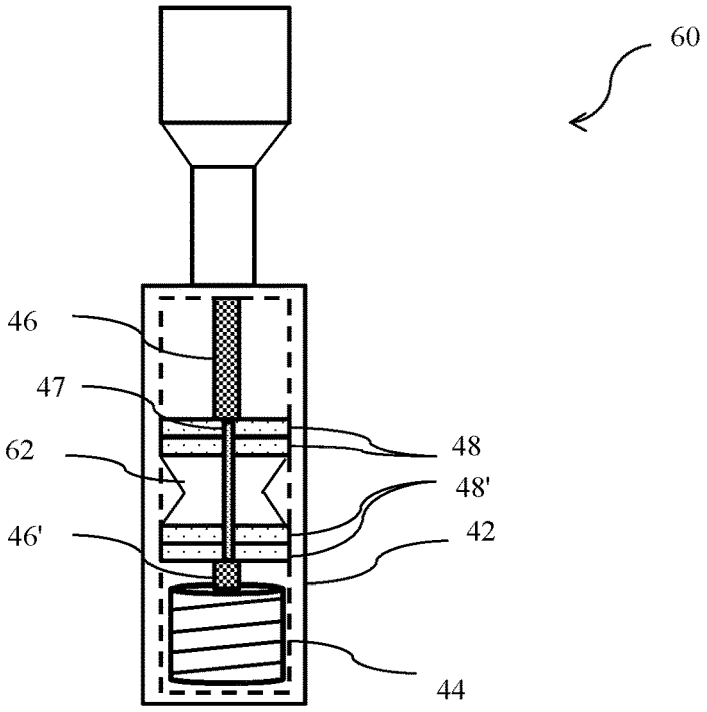
FIG. 6 is a diagram showing a cut-away schematic of an illustrative downhole severing tool comprising a two-stage energizing material in columnar form containing a central shaped charge in accordance with aspects of the present disclosure.

In some embodiments, the columnar form may further comprise a shaped charge located between the opposing ends of the columnar form, as depicted in FIG. 6. FIG. 6 is a diagram showing a cut-away schematic of an illustrative downhole severing tool 60 comprising a two-stage energizing material in columnar form containing a central shaped charge 62 in accordance with aspects of the present disclosure. With exception to the disposition of reactive disks 48 and 48' above and below shaped charge 62, respectively, the remaining elements depicted in FIG. 6 are similar to those depicted in FIG. 4 and will not be described again in detail. It should also be noted that the configuration depicted in FIG. 6 differs from the configuration of FIG. 3 in its sequenced detonation to produce colliding shockwaves.

Shaped charge 62 may provide a number of benefits when employing the configuration of FIG. 6 to sever a tubular structure. In some embodiments, shaped charge 62 may be detonated prior to arrival of the opposing shockwaves. In such embodiments, the jet cutting action of shaped charge 62 may at least partially cut a tubular structure so that the tubular structure can be more easily severed when the outward pressure wave arrives following shockwave collision. Choice of an appropriate detonation sequence can be determined by one having ordinary skill in the art. In either case, shaped charge 62 may comprise the exemplary configurations described herein, such as that depicted in FIG. 1 and described above. In general, shaped charges used in such embodiments may utilize a standard high explosive in the shaped charge, rather than a two-stage energizing material, as depicted in FIG. 1. It should be recognized, however, that use of a two-stage energizing material in the shaped charge of such embodiments is not precluded.

Methods for severing a tubular structure in a wellbore are also contemplated by various embodiments of the present disclosure. The type of tubular structure being severed by a tool comprising a two-stage energizing material is not believed to be particularly limited and may comprise any tubular structure that is encountered in conjunction with drilling and operating a wellbore. Exemplary tubular structures that may be severed by the techniques described herein are set forth hereinabove. As also referenced hereinabove, the type of tubular structure being severed, as well as where severing needs to take place in the wellbore, can dictate how the severing operation is best performed. Given the benefit of this disclosure, one having ordinary skill in the art will be able to make such a determination.

In various embodiments, methods described herein may comprise positioning a two-stage energizing material in a tubular structure within a wellbore, the two-stage energizing material comprising a high explosive and a reactive energizing material; and initiating a primary reaction of the high explosive that propagates a secondary reaction of the reactive energizing material, so as to detonate the two-stage energizing material.

In various embodiments, initiating the primary reaction of the high explosive may comprise detonating the high explosive. Detonation of the high explosive may provide the activation energy needed for initiating the secondary reaction of the reactive energizing material. In addition to supplying the activation energy needed for initiating the secondary reaction, the energy supplied by the primary reaction may also supply the energy needed for propagating the secondary reaction.

In various embodiments, positioning the two-stage energizing material in a tubular structure within a wellbore may comprise disposing the two-stage energizing material at or above a location where a stuck pipe occurs, which may comprise lowering a tool containing the two-stage energizing material through the tubular structure. In some embodiments, the methods may further comprise assaying the wellbore to determine the location of a stuck pipe (e.g., by using a wireline instrument). Other features of the wellbore may also be probed when determining the location of the stuck pipe. For example, the hydrostatic pressure or chemistry of the wellbore may be probed to determine a suitable explosive yield or explosive material. Once the location where the tubular structure needs to be severed and other possible factors have been determined with a degree of certainty, the methods can comprise arming a tool containing the two-stage energizing material and lowering the tool into a desired location within the wellbore. Suitable tool configurations are exemplified by the illustrative tool configurations described hereinabove. Illustrative techniques for deploying such tools within a tubular structure in a wellbore will be familiar to one having ordinary skill in the art.

In various embodiments, the methods described herein may comprise severing the tubular structure as a result of detonating the two-stage energizing material. As described above, the type of severance obtained upon detonating the two-stage energizing material may be dictated, at least in part, by the configuration of the two-stage energizing material within a tool. Illustrative severance types may include "bursting" cuts of the tubular structure with an outward pressure wave, where there is no apparent order to the cutting edge, and "precision" cuts of the tubular structure, where the tubular structure is sliced in a regular fashion across its diameter.

Embodiments disclosed herein include:

A. Downhole severing tools containing a two-stage energizing material. The downhole severing tools comprise: a housing; a two-stage energizing material within the housing, the two-stage energizing material comprising a high explosive and a reactive energizing material; at least one initiator coupled to the two-stage energizing material at least at a first location; and a detonator coupled to the at least one initiator; wherein upon detonation of the two-stage energizing material, the high explosive undergoes a primary reaction that propagates a secondary reaction of the reactive energizing material.

B. Methods for severing a tubular structure in a subterranean formation. The methods comprise: positioning a two-stage energizing material in a tubular structure within a wellbore, the two-stage energizing material comprising a high explosive and a reactive energizing material; and initiating a primary reaction of the high explosive that propagates a secondary reaction of the reactive energizing material, so as to detonate the two-stage energizing material.

Each of embodiments A and B may have one or more of the following additional elements in any combination:

Element 1: wherein the two-stage energizing material comprises a shaped charge having a concave region on its exterior, the exterior of the concave region being defined by a liner, behind which is housed the two-stage energizing material.

Element 2: wherein the at least one initiator passes longitudinally through the shaped charge.

Element 3: wherein the two-stage energizing material comprises a reactive disk, one or more reactive disks being stacked above and below a shaped charge in the housing.

Element 4: wherein the shaped charge also comprises a two-stage energizing material comprising a high explosive and a reactive energizing material.

Element 5: wherein the two-stage energizing material is configured in a columnar form within the housing, and first and second initiators are coupled to the two-stage energizing material at opposing ends of the columnar form; wherein the opposing ends of the columnar form are configured to detonate in sequence with one another.

Element 6: wherein the columnar form further comprises a shaped charge located between the opposing ends of the columnar form.

Element 7: wherein a third initiator is coupled to the shaped charge.

Element 8: wherein the two-stage energizing material comprises a reactive disk, one or more reactive disks being stacked above and below the shaped charge to create the columnar form.

Element 9: further comprising a third initiator coupled to the two-stage energizing material at a location between the opposing ends of the columnar form.

Element 10: wherein the two-stage energizing material comprises an oxidizer.

Element 11: wherein the two-stage energizing material comprises a thermobaric material.

Element 12: wherein the thermobaric material comprises a metal selected from the group consisting of aluminum, titanium, zirconium, barium, potassium, cesium, sodium, magnesium, and any combination thereof.

Element 13: wherein the thermobaric material comprises particulates that are about 1 micron or less in size.

Element 14: wherein the two-stage energizing material comprises a substance selected from the group consisting of a metal, a metal salt, a chloride salt, a fluoride salt, an acetate salt, a sulfate salt, a diazonium salt, a bromate salt, a chlorate salt, a chlorite salt, a perchlorate salt, a nitrate salt, a propellant, an oxidizer, and any combination thereof.

Element 15: wherein initiating the primary reaction of the high explosive comprises detonating the high explosive, the detonation of the high explosive providing the activation energy needed for initiating the secondary reaction of the reactive energizing material.

Element 16: wherein the method further comprises severing the tubular structure as a result of detonating the two-stage energizing material.

Element 17: wherein the two-stage energizing material is configured in a columnar form.

Element 18: wherein the two-stage energizing material is detonated from opposing ends of the columnar form; wherein detonating the two-stage energizing material produces shockwaves from the opposing ends of the columnar form that migrate toward a location between the opposing ends of the columnar form.

Element 19: wherein the shaped charge is located where the shockwaves meet within the columnar form.

Element 20: wherein the method further comprises detonating the shaped charge.

Element 21: wherein the two-stage energizing material is detonated substantially simultaneously at the opposing ends of the columnar form.

Element 22: wherein the two-stage energizing material is also detonated at a location between the opposing ends of the columnar form.

By way of non-limiting example, exemplary combinations applicable to A and B include:

The downhole severing tool of A in combination with elements 1 and 11.

The downhole severing tool of A in combination with elements 3 and 4.

The downhole severing tool of A in combination with elements 3 and 5.

The downhole severing tool of A in combination with elements 5 and 6.

The downhole severing tool of A in combination with elements 5 and 8.

The downhole severing tool of A in combination with elements 5 and 10.

The downhole severing tool of A in combination with elements 5 and 11.

The downhole severing tool of A in combination with elements 5, 11 and 13.

The method of B in combination with elements 1 and 11.

The method of B in combination with elements 11 and 1.

The method of B in combination with elements 15 and 16.

The method of B in combination with elements 8 and 18.

The method of B in combination with elements 6, 8, and 18.

The method of B in combination with elements 6, 17 and 19.

The method of B in combination with elements 11, 12 and 15.

The method of B in combination with elements 14 and 15.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to one skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While embodiments are described in terms of "comprising," "containing," or "including" various components or steps, the embodiments can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is the following:

1. A downhole severing tool comprising:

a housing;

a two-stage energizing material within the housing, the two-stage energizing material forming a monolithic structure comprising a high explosive and a reactive energizing material;

at least one initiator coupled to the two-stage energizing material at least at a first location; and a detonator coupled to the at least one initiator;

wherein upon detonation of the two-stage energizing material, the high explosive undergoes a primary reaction that propagates a secondary reaction of the reactive energizing material.

2. The downhole severing tool of claim 1, wherein the two-stage energizing material comprises a shaped charge having a concave region on an exterior of the shaped charge, the exterior of the concave region being defined by a liner, behind which is housed the two-stage energizing material.

3. The downhole severing tool of claim 2, wherein the at least one initiator passes longitudinally through the shaped charge.

4. The downhole severing tool of claim 1, wherein the two-stage energizing material comprises a reactive disk, one or more reactive disks being stacked above or below a shaped charge in the housing.

5. The downhole severing tool of claim 4, wherein the two-stage energizing material comprises the shaped charge.

6. The downhole severing tool of claim 1, wherein the two-stage energizing material is configured in a columnar form within the housing, and first and second initiators are coupled to the two-stage energizing material at opposing ends of the columnar form;

wherein the opposing ends of the columnar form are configured to detonate in sequence with one another.

7. The downhole severing tool of claim 6, wherein the columnar form further comprises a shaped charge located between the opposing ends of the columnar form.

8. The downhole severing tool of claim 7, further comprising a third initiator coupled to the shaped charge.

9. The downhole severing tool of claim 7, wherein the two-stage energizing material comprises a reactive disk, one or more reactive disks being stacked above or below the shaped charge to create the columnar form.

10. The downhole severing tool of claim 6, further comprising a third initiator coupled to the two-stage energizing material at a location between the opposing ends of the columnar form.

11. The downhole severing tool of claim 1, wherein the two-stage energizing material comprises an oxidizer.

12. The downhole severing tool of claim 1, wherein the two-stage energizing material comprises a thermobaric material.

13. The downhole severing tool of claim 12, wherein the thermobaric material comprises a metal selected from the group consisting of aluminum, titanium, zirconium, barium, potassium, cesium, sodium, magnesium, and any combination thereof.

14. The downhole severing tool of claim 13, wherein the thermobaric material comprises particulates that are about 1 micron or less in size.

15. The downhole severing tool of claim 1, wherein the two-stage energizing material comprises a substance selected from the group consisting of a metal, a metal salt, a chloride salt, a fluoride salt, an acetate salt, a sulfate salt, a diazonium salt, a bromate salt, a chlorate salt, a chlorite salt, a perchlorate salt, a nitrate salt, a propellant, an oxidizer, and any combination thereof.

16. A method comprising:

positioning a two-stage energizing material in a tubular structure within a wellbore, the two-stage energizing material forming a monolithic structure comprising a high explosive and a reactive energizing material; and initiating a primary reaction of the high explosive that propagates a secondary reaction of the reactive energizing material, so as to detonate the two-stage energizing material.

17. The method of claim 16, wherein initiating the primary reaction of the high explosive comprises detonating the high explosive, the detonation of the high explosive providing the activation energy needed for initiating the secondary reaction of the reactive energizing material.

18. The method of claim 16, further comprising:

severing the tubular structure as a result of detonating the two-stage energizing material.

19. The method of claim 16, wherein the two-stage energizing material comprises a shaped charge having a concave region on an exterior of the shaped charge, the exterior of the concave region being defined by a liner, behind which is housed the two-stage energizing material.

20. The method of claim 16, wherein the two-stage energizing material comprises a reactive disk, one or more reactive disks being stacked above or below a shaped charge.

21. The method of claim 16, wherein the two-stage energizing material is configured in a columnar form.

22. The method of claim 21, wherein the two-stage energizing material is detonated from opposing ends of the columnar form;

wherein detonating the two-stage energizing material produces shockwaves from the opposing ends of the columnar form that migrate toward a location between the opposing ends of the columnar form.

23. The method of claim 22, wherein the columnar form further comprises a shaped charge located between the opposing ends of the columnar form.

24. The method of claim 23, wherein the shaped charge is located where the shockwaves meet within the columnar form.

25. The method of claim 23, wherein the two-stage energizing material comprises a reactive disk, one or more reactive disks being stacked above or below the shaped charge to create the columnar form.

26. The method of claim 23, further comprising:

detonating the shaped charge.

27. The method of claim 22, wherein the two-stage energizing material is detonated substantially simultaneously at the opposing ends of the columnar form.

28. The method of claim 22, wherein the two-stage energizing material is also detonated at a location between the opposing ends of the columnar form.

29. The method of claim 16, wherein the two-stage energizing material comprises an oxidizer.

30. The method of claim 16, wherein the two-stage energizing material comprises a thermobaric material.

31. The method of claim 16, wherein the two-stage energizing material comprises a substance selected from the group consisting of a metal, a metal salt, a chloride salt, a fluoride salt, an acetate salt, a sulfate salt, a diazonium salt, a bromate salt, a chlorate salt, a chlorite salt, a perchlorate salt, a nitrate salt, a propellant, an oxidizer, and any combination thereof.

* * * * *